United States Patent [19]

Klein

[11] Patent Number: 4,520,852

[45] Date of Patent: Jun. 4, 1985

[54] POLLUTION PREVENTION DEVICE

[76] Inventor: William T. Klein, 33 Valley Ave., Locust Valley, N.Y. 11560

[21] Appl. No.: 476,935

[22] Filed: Mar. 21, 1983

[51] Int. Cl.[3] ..... B65B 3/04

[52] U.S. Cl. ..... 141/86; 141/98; 141/286; 52/19; 137/312; 138/89; 210/172; 210/282; 277/11; 277/189; 277/212 FB; 285/205

[58] Field of Search ..... 137/312–314, 137/364, 371; 285/42, 43, 44, 192, 205; 52/19–21; 4/286, 293, 295; 277/212 FB, 11, 189; 210/172, 282, 460, 508, 506, 100, DIG. 5, 97, 418, 419, 502.1; 175/66, 206; 55/466; 166/364, 228; 405/60; 141/85–88, 285–310, 115, 59, 98, 392; 138/89

[56] References Cited

U.S. PATENT DOCUMENTS

| | | | |
|---|---|---|---|
| 2,849,070 | 8/1958 | Maly | 277/11 |
| 4,032,453 | 6/1977 | Pedone | 210/502.1 |
| 4,278,115 | 7/1981 | Briles et al. | 141/86 |

*Primary Examiner*—Houston S. Bell, Jr.
*Attorney, Agent, or Firm*—Kane, Dalsimer, Kane, Sullivan & Kurucz

[57] ABSTRACT

A pollution prevention device for use in association with a fill pipe for the passing of material to a container, the device includes a basin positioned about the end of the fill pipe and capable of collecting a predetermined amount of the material spilled during the filling or emptying of the container through the fill pipe.

7 Claims, 4 Drawing Figures

POLLUTION PREVENTION DEVICE

FIELD OF THE INVENTION

The present invention is directed towards providing a pollution prevention device, particularly one for use in conjunction with a filling or dispensing outlet of a container, pipeline, etc.

BACKGROUND OF THE INVENTION

Present day concern for the environment and the safety of the public is ever increasing. This is especially true in the handling of pollutants such as toxic chemicals, waste and petroleum products such as gasoline, fuel oil, etc., and others. This concern is exemplified by the emergence of devices which detect leaks in the structures containing such material as illustrated in U.S. Pat. Nos. 4,305,068 issued Dec. 8, 1981; 3,995,472 issued Dec. 7, 1976; and 3,564,526 issued Feb. 16, 1971.

A significant problem in the handling of potential pollutants aside from rupturing or leaking of the containers is overflow or spillage during the filling (or emptying) of the container. This is particularly critical in situations where the spillage is absorbed by the ground and finds its way into the ground water table, contaminating the water supply. While spillage or overflow can occur during the filing of elevated as well as underground containers, due to the proximity of the soil underground tanks are of particular concern. A frequent example of this is when a chemical containing tank is overfilled or upon delivery of fuel etc., by a truck, the operator fails to drain the delivery hose before disconnecting it from the fill pipe, the removal of which from the fill pipe causes the material in the hose to spill out. Not only does such spillage pose a great danger to the environment, but in addition, if the container is equipped with one of the leak detector sets as set forth in the aforenoted patents, such spillage could activate the detector thereby falsely indicating a leak. Such a false alarm would lead not only to great inconvenience but expense as well. Note that due to the potential widespread application, i.e., commercial, municipal, and residential, a device for controlling pollutants in this regard should be relatively simple and inexpensive and readily adaptable for a variety of applications.

SUMMARY OF THE INVENTION

Accordingly, it is a principal object of the invention to provide for a pollution prevention device which serves to control the overflow or spillage of pollutants during the filling (or emptying) of the container.

It is another object of the invention to provide for a pollutant prevention device which is relatively simple, inexpensive and adaptable to a wide variety of applications, from the simple home owner to the large municipal and commercial establishments.

The present invention provides for a pollution device which is positioned in a sealed arrangement about the outlet port or fill pipe of a container, particularly underground tanks, etc., which are intended to contain toxic chemicals, fuel or other possible pollutants. The device includes a cylindrical basin into which the fill pipe passes having its capped end positioned therein. The upper or open end of the basin allows access to the fill pipe and is of sufficient width so that spills or overflows collect in the bottom or closed end of the basin rather than flowing into the ground water. A drain is provided in the basin which prevents the drawing off of the chemicals spilled, such as hydrocarbons, but permits water to pass through so that surface water will not tend to collect in the device.

BRIEF DESCRIPTION OF THE DRAWINGS

Thus by the present invention its objects and advantages will be realized, the description of which should be taken in conjunction with the drawings wherein.

DETAILED DESCRIPTION OF THE PREFERRED EMBODIMENT

Figure 1:
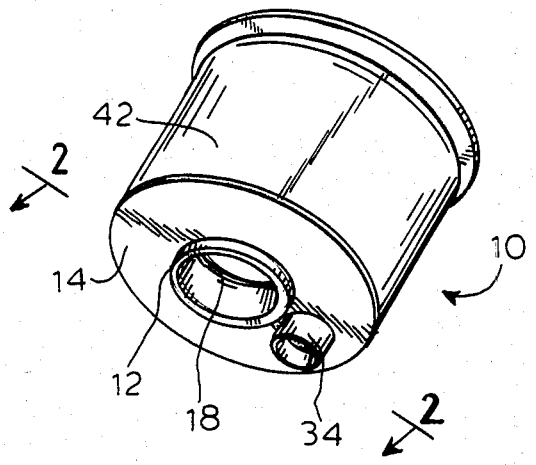
FIG. 1 is a perspective view of the pollution control device, incorporating the teachings of the present invention.
Figure 2:
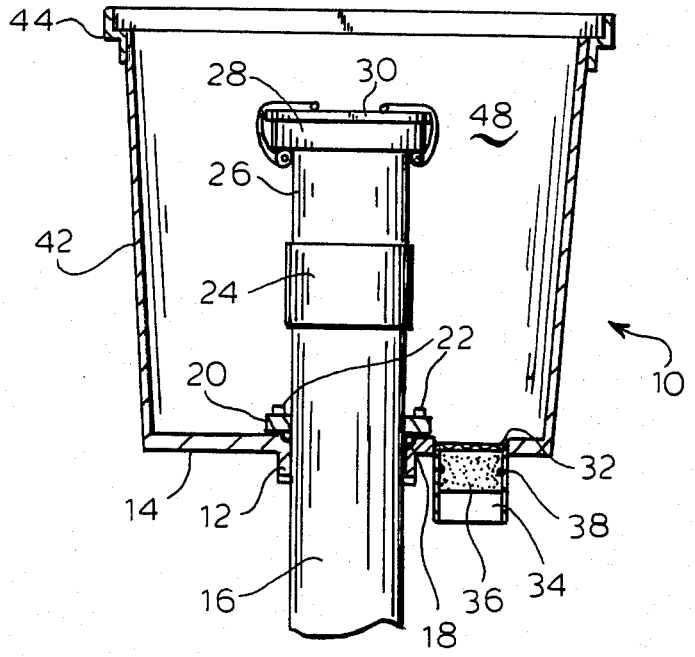
FIG. 2 is a sectional view of a first embodiment of the pollution control device, incorporating the teachings of the present invention.

With reference now more particularly with regard to FIG. 1 there is shown a detailed pollution control device 10 which is cylindrical in nature, and may be fabricated out of steel, plastic etc., or any other material suitable for purpose. An axially disposed opening 12 is provided in the bottom or closed end 14 of the device 10 through which is inserted a fill pipe 16 as shown in FIG. 2, which may be coupled to a container such as a tank, pipeline, etc., containing fuel oil or toxic chemicals for example. An "O" ring seal 18 is provided about the opening 12 so as to provide a seal between the bottom 14 of the device 10 and the pipe 16. A circular clamp 20 may also be provided about the opening 12 so as to clamp the pipe 14, seal 16, and bottom 14 together via screws 22, made of perhaps brass or stainless steel so as to be relatively non-corrosive. Note that the O-ring seal 18 should be made of a material which does not degrade in the presence of the material in the container which may be involved in a spill and may be designed to extend upwardly to cover substantially the entire portion of the fill pipe 16 within the device 10. Of course, the O-ring seal is merely used as an example and other means of sealing the bottom 14 to the fill pipe 16 suitable for purpose may also be utilized.

The filler pipe 16 may include a threaded coupling 24 which is attached to a stem 26 and outlet 28 having a filler cap 30 detachably maintained thereon.

A second opening 32 is provided on bottom 14 which includes a downwardly extending sleeve 34. Positioned in the opening 32 is a cartridge 36 containing perhaps imbiber beads which would allow water to pass through or drain out while swelling in the presence of the potential pollutants, such as hydrocarbons so as to prevent outward flow. An appropriate sealing means 38 such as an O-ring would be positioned between the cartridge 26 and sleeve 34 if necessary. The cartridge 36 serves to prevent the accumulation of water in the basin area 48, formed by the bottom 14, upwardly extending cylindrical wall 42 therefrom and outer surface of the fill pipe 16. The bottom 14 and wall 42 may be joined integrally or otherwise as long as a fluid tight seal exists therebetween. In addition, the basin 48 may comprise a removable insert formed of a particular material for a particular application with the bottom 14 and sidewall 42 (and the outer surface of pipe 16) forming the shell for the insert. Such an insert while adding to the versitility of the device may also be used to periodically remove spilt material, if so desired.

The top of wall 42 terminates at a stepped portion 44 formed integrally or mechanically coupled, bonded or sealed thereto which may provide a surface for receipt of a cover. For example, if the device is used with an underground storage tank, it can be positioned on the upwardly extending fill pipe 16 with the stepped portion 44 positioned flush with the ground level. A cover, similar to manhole covers used on city streets, can be placed thereon.

Since the basin 40 and cover are normally not completely sealed, the possibility that water may enter in the basin 48 by way of its open end exists. Accordingly, cartridge 36 serves to allow the water to drain off and out sleeve 34, the opening of which would be positioned to be clear of obstruction.

Note that the height of the pipe's open end is a considerable distance from the bottom 14 so as to be accessible even after a considerable spill has taken place. Since water will drain out after it accumulates in the basin 48, this will not pose a problem of submerging the fill pipe outlet 28. As to the material spilled, this can periodically be removed from the basin 48 by perhaps a syphon arrangement which may be coupled to the bottom 14 of the device to facilitate draw off. Other means of drawing off such as the insert arrangement aforenoted may of course also be used, if so desired.

Figure 3:
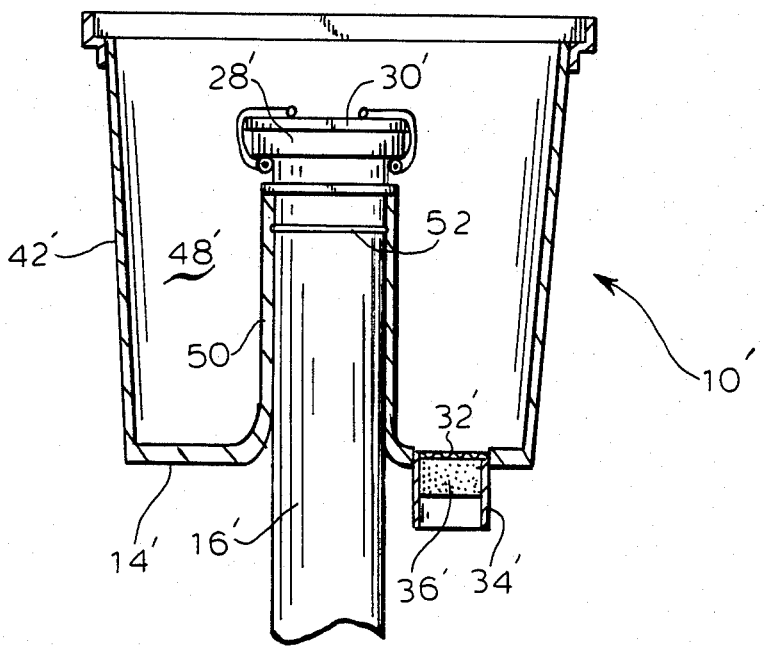
FIG. 3 is a sectional view of a second embodiment of the pollution control device, incorporating the teachings of the present invention.

Turning now to FIG. 3, there is shown a device similar to that in FIGS. 1 and 2, with like parts similarly numbered however designated with a prime. This embodiment differs from the first in that an upwardly extending interior circular wall 50 is provided. A worm gear clamp 52 or other sealing means such as silicone or epoxy is provided between the fill pipe 16' and the exterior surface of wall 50 so as to create a seal therebetween. The fill pipe 16' extends a short distance above the aforenoted seal with cap 30' on the outlet end 28' of the pipe 16'. The advantage of this embodiment is that the interior wall 50 rather than the exterior surface of pipe 16' is used as a containing wall for spills and overflows. Under certain circumstances this may be advantageous.

Figure 4:
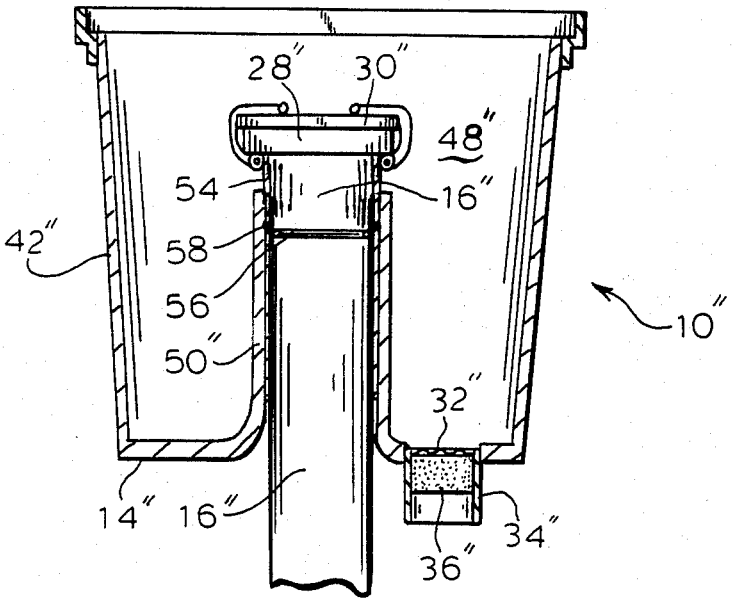
FIG. 4 is a variation of the embodiment shown in FIG. 3.

The embodiment shown in FIG. 4 offers similar advantages to that shown in FIG. 3 with like parts similarly numbered however designated with a double prime. This embodiment provides for the fill pipe 16'' to extend upwardly to a point within interior circular wall 50''. Interposed between the exterior of pipe 16'' and the interior wall 50'' is a sleeve 54 which extends along a portion of the wall 50'' and pipe 16'' terminating in an outlet 28'' with a cap 30'' thereon. The inner surface of the sleeve 54 is cemented or otherwise sealed to pipe 16'' i.e., caulking, epoxy etc. Similarly the outer surface of the sleeve 54 is sealed at 58 to the exterior surface of wall 50'' adjacent thereto so as to complete the seal between the fill pipe 16'' and the interior of the basin 48''.

Thus by the aforenoted invention its objects and advantages are realized and although preferred embodiments have been disclosed and described in detail herewith, its scope should not be limited thereby rather its scope should be determined by that of the appended claims.

What is claimed is:

1. A pollution prevention device for use in association with a fill pipe for filling a storage tank and the like, said device comprising:

a basin positioned about a fill pipe so as to contain liquid spilled during filling or emptying of material through the fill pipe;

said basin includes a bottom and sidewall upwardly extending from the bottom, said bottom includes an opening through which a fill pipe extends upwardly and passes into an area partially defined by the bottom and sidewall, said opening includes a sealing means positioned thereabout and engageable with the outer surface of the fill pipe so as to form a seal therebetween, said sidewall, bottom and outer surface defining an area of the basin capable of holding spilt liquid; and outlet means provided for said basin which includes means capable of allowing drainage of water from the basin while preventing the spilt liquid from passing through said means so as to collect the spilt liquid in the basin while allowing the run-off of water.

2. The pollution prevention device in accordance with claim 1 wherein said sidewall terminates at its upper end in a platform capable of maintaining a cover resting thereon.

3. The pollution prevention device in accordance with claim 2 wherein said sidewall and bottom are made of a plastic material and sealably joined together, said sidewall being cylindrical and the bottom circular in shape, said opening being axially positioned in the bottom so as to axially position a fill pipe when positioned therein.

4. The pollution prevention device in accordance with claim 1 wherein said basin includes a bottom having an opening having an upwardly extending interior sidewall therefrom through which a fill pipe passes; outer sidewall upwardly extending from the bottom at a predetermined distance from the interior sidewall, sealing means between said interior sidewall and the fill pipe to create a seal therebetween, and said interior and outer sidewalls and bottom defining an area of the basin capable of holding split liquid.

5. The pollution prevention device in accordance with claim 4 wherein said sidewall terminates at its upper end in a platform capable of maintaining a cover resting thereon.

6. The pollution prevention device in accordance with claim 5 wherein said sidewall and bottom are made of a plastic material and sealably joined together, said sidewall being cylindrical and the bottom circular in shape, said opening and interior sidewall being axially positioned in the bottom so as to axially position the fill pipe when positioned thereon.

7. The pollution prevention device in accordance with claim 4 wherein the sealing means includes a sleeve disposed between the interior side wall and the fill pipe extending upward into the basin and terminating in a removable fill cap allowing access to the fill pipe, and seal between the interior side wall and the sleeve and the sleeve and the fill pipe.

* * * * *